US006592122B2

(12) United States Patent
Ikenaga

(10) Patent No.: US 6,592,122 B2
(45) Date of Patent: Jul. 15, 2003

(54) THREE-DIMENSIONAL MANIPULATIVE PUZZLE

(76) Inventor: Hiroshi M. Ikenaga, Choapan No. 381-6, Col. Hipodromo de la Condesa, D.F., C.P. (MX), 06170

( * ) Notice: Subject to any disclaimer, the term of this patent is extended or adjusted under 35 U.S.C. 154(b) by 0 days.

(21) Appl. No.: 09/970,625

(22) Filed: Oct. 4, 2001

(65) Prior Publication Data

US 2003/0067113 A1 Apr. 10, 2003

(51) Int. Cl.[7] ..... A63F 9/08
(52) U.S. Cl. ..... 273/153 S
(58) Field of Search ..... 273/153 R, 153 S, 273/155, 157 R; 40/327; 434/172, 402, 403, 426

(56) References Cited

U.S. PATENT DOCUMENTS 2,504,650 A * 4/1950 Chessrown ..... 273/155
3,488,880 A * 1/1970 Taylor ..... 273/155
3,596,380 A * 8/1971 Williams ..... 273/155
5,074,562 A * 12/1991 Green ..... 273/153 S

* cited by examiner

*Primary Examiner*—Steven Wong
(74) *Attorney, Agent, or Firm*—Koda & Androlia

(57) ABSTRACT

A three-dimensional manipulative puzzle including a sphere, a pattern of indicia provided on the surface of the sphere, a ring slidably provided on the sphere and a partial pattern of the pattern of indicia provided on a surface of the ring. The partial pattern provided on the surface of the ring is provided such that it only aligns with the pattern on the surface of the spherical member at only one position. Accordingly, the three-dimensional manipulative puzzle is solved by a user by aligning the partial pattern on the ring member with the pattern on the spherical member.

6 Claims, 3 Drawing Sheets

THREE-DIMENSIONAL MANIPULATIVE PUZZLE

BACKGROUND OF THE INVENTION

1. Field of the Invention

This invention relates to a three-dimensional manipulative puzzle which is useful as a play thing and/or to teach a systematic approach to problem solving.

2. Prior Art

Three-dimensional manipulative puzzles of various sources are well known in the art. One of the most famous three-dimensional manipulative puzzle was called the "Rubiks" cube and was invented by Professor Erno Rubik. Other manipulative puzzles are disclosed in U.S. Pat. Nos. 4,513,907, 4,540,177, 4,593,907, 6,217,023 and 6,027,116.

While these other types of three-dimensional manipulative puzzles may exist in the prior art, they have several common disadvantages. Such disadvantages include that they are made up of a great number of complicated pieces which are interconnected by a complicated structure and difficult to easily manufacture. The fact that these three-dimensional manipulative puzzles are made from a great number of pieces provides another disadvantage in that if the puzzle was to come apart, it results in the generation of a great number of small pieces which present a choking hazard to small children.

SUMMARY OF THE INVENTION

Accordingly, it is the general object of the present invention to overcome the disadvantages of the prior art.

In particular, it is an object of the present invention to provide a three-dimensional manipulative puzzle which is made from a small number of pieces, is easy to manufacture and is still capable of maintaining the interest of an user for a substantial period of time.

In keeping with the principles of the present invention, the objects are accomplished by a unique three-dimensional manipulative puzzle including a spherical member, a plurality of indicia provided on a surface of the spherical member in a predetermined pattern, a ring member slidably provided on the spherical member and a partial pattern of the plurality of indicia provided on a surface of the ring member which align with the pattern on the spherical member at only one position. The puzzle is solved when a user aligns the partial pattern on the ring member with the pattern on the surface of the spherical member.

BRIEF DESCRIPTION OF THE DRAWINGS

The abovementioned features and objects of the present invention will become more apparent with reference to the following description taken in conjunction with the accompanying drawings wherein like reference numerals denote like elements and in which.

DETAILED DESCRIPTION OF THE INVENTION

Figure 1:
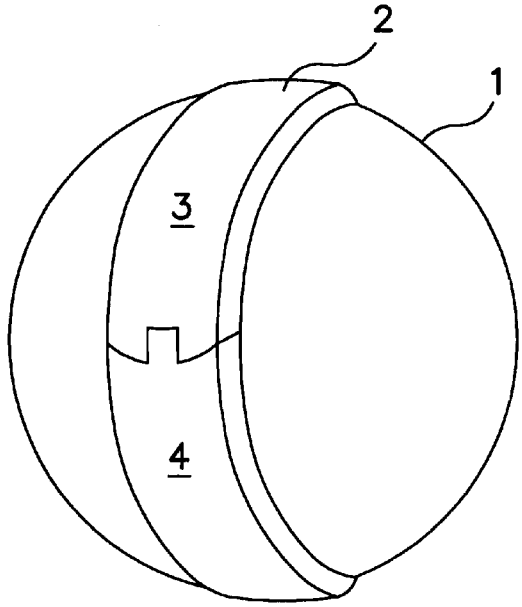
FIG. 1 is a simplified view of the first embodiment of the present invention.
Figure 2:
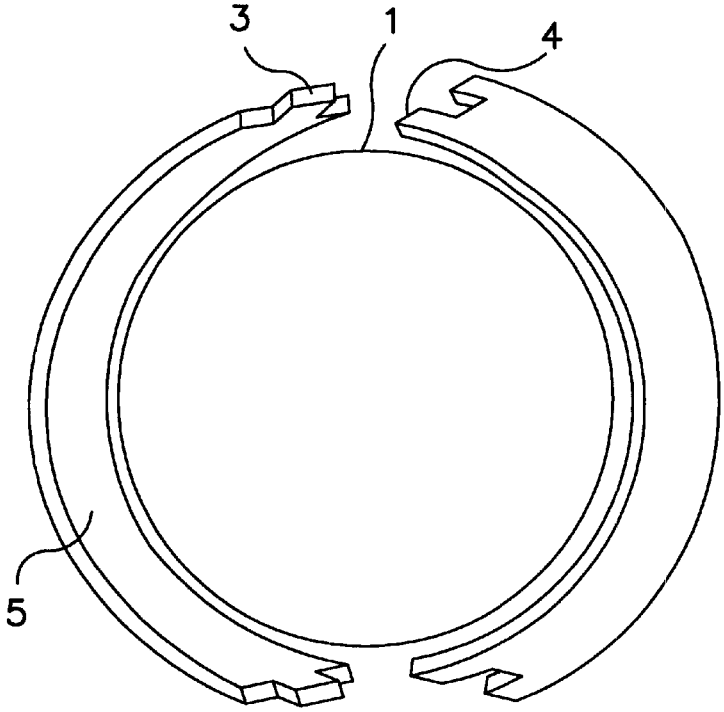
FIG. 2 is a view illustrating the construction of the ring member utilized in the first embodiment of the present invention.

Referring to FIGS. 1–2, shown therein are simplified views of the basic elements of the first embodiment of the present invention. In particular, the three-dimensional manipulative puzzle of the present invention comprises a spherical member 1 and a ring member 2 provided slidably fitted onto the spherical member 1. The ring member 2 is slightly larger in inner diameter than the outer diameter of the: spherical member 1; however, the ring member 2 is further designed to have a curved inner surface 5 so that when the ring member 2 is fitted onto the spherical member 1, the ring member 2 cannot fall off and merely slides around the spherical member 1.

One way of manufacturing the ring member 2 is to provide two interlocking pieces 3 and 4. The two interlocking pieces 3 and 4 are fitted onto the spherical member and the interlocking joints are snapped together and preferably permanently bonded together using either a thermal process or an adhesive. It would also be possible to make the ring member 2 from a single unitary structure. In such a case, the ring member 2 would be made from a material which is flexible so that it could be press-fitted onto the spherical member 1. Suitable materials for the spherical member 1 and the ring member 2 are various types of resins, particularly those which can be injection molded or which can be utilized in other low cost processes to make the ring member 2 and the spherical member 1. Also, the spherical member 1 can be hollow or solid.

Figure 3:
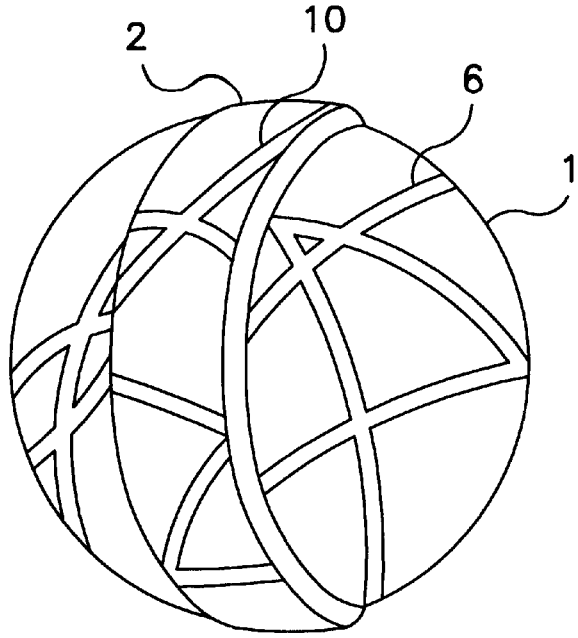
FIG. 3 is an embodiment of the present invention illustrating a first pattern of indicia which can be utilized in the present invention.
Figure 4:
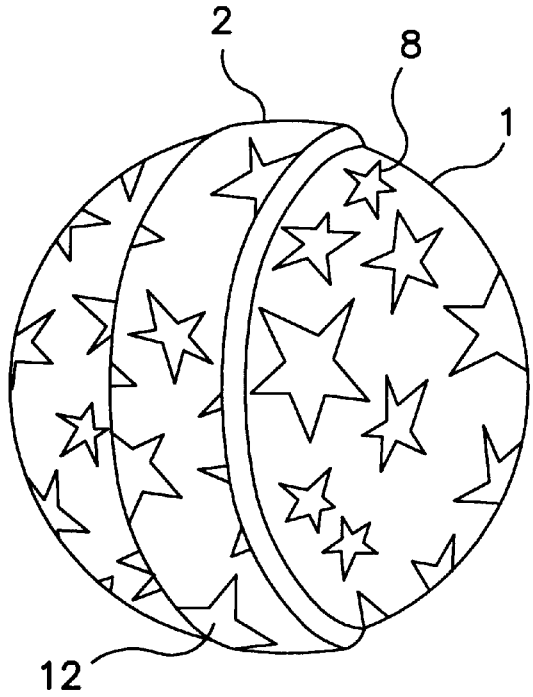
FIG. 4 is another illustration showing a second pattern of indicia utilized in the present invention.

Referring to FIGS. 3 and 4, shown therein are three-dimensional manipulative puzzles in accordance with the teachings of the present invention which illustrate two patterns of indicia which could be provided on the three-dimensional manipulative puzzle. In particular, the surface of the spherical member 1 is provided with a plurality of indicia such as lines 6 in FIG. 3 and geometric symbols such as stars 8 in FIG. 4. This pattern of indicia is provided in a predetermined manner on the surface of the spherical member 1. A partial pattern of indicia such as lines 10 in FIG. 3 and stars 12 in FIG. 4 are provided on the ring member 2. This partial pattern provided on the ring member 2 is designed so that it only aligns with the pattern on the surface of the spherical member 1 when the ring member 2 is moved to only one particular orientation or position relative to the pattern on the spherical member 1.

In use, the user would move the ring member 2 around until the partial pattern formed on the ring member 2 aligns with the pattern on the surface of the spherical member 1. In this way, the user would solve the puzzle.

Figure 5:
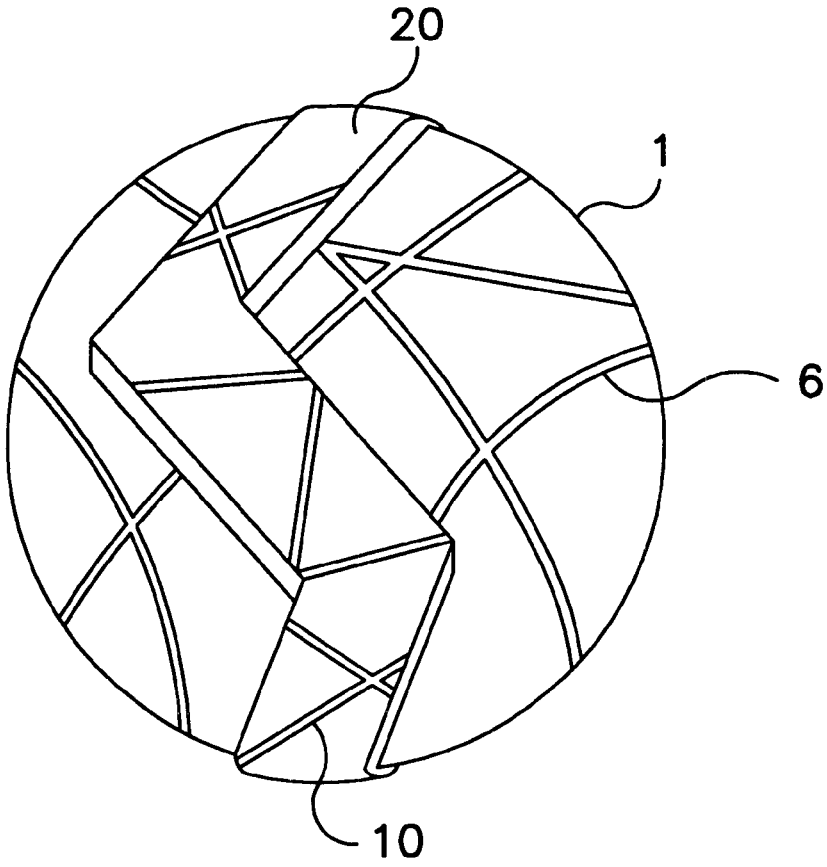
FIG. 5 is a second embodiment of the present invention wherein the ring member is formed in a zig-zag pattern.

Referring to FIG. 5, shown therein is a second embodiment of a puzzle in accordance with the teachings of the present invention and illustrates that the ring member need not be a pure ring and can take other shapes. This puzzle is substantially the same as that of the first embodiment except that the three-dimensional manipulative puzzle of FIG. 5 illustrates that the ring member 2 in FIGS. 1–4 could be provided in other shapes such as the zig-zag shape of the ring member 20 in FIG. 5. In all other respects, the three-dimensional manipulative puzzle is the same as that of the first embodiment.

It should also be apparent to those skilled in the art that the above-described embodiments are merely illustrative of the present invention and numerous other embodiments could be readily devised by those ordinary skill in the art without departing from the spirit and scope of the present invention.

I claim:

1. A three-dimensional manipulative puzzle comprising:

a spherical member;

a plurality of indicia provided on a surface of said spherical member in a predetermined pattern;

a ring member slidably provided on an external surface of said spherical member for sliding in all directions on said external surface; and a partial pattern of said plurality of indicia provided on a surface of said ring member which align with said predetermined pattern on said spherical member at only one position;

whereby said puzzle is solved when the user aligns said partial pattern on said ring member with said predetermined pattern on said spherical member.

2. The three-dimensional manipulative puzzle according to claim 1 wherein the indicia is selected from the group consisting of lines and geometrical symbols.

3. The three-dimensional manipulative puzzle according to claim 2 wherein the spherical member and the ring member are made from a plastic resin.

4. A three-dimensional manipulative puzzle comprising:

a spherical member;

a plurality of indicia provided on a surface of said spherical member in a predetermined pattern;

a ring member slidably provided on said spherical member; and a partial pattern of said plurality of indicia provided on a surface of said ring member which align with said predetermined pattern on said spherical member at only one position;

whereby said puzzle is solved when the user aligns said partial pattern on said ring member with said predetermined pattern on said spherical member; and wherein said ring member is of a zig-zag shape.

5. The three-dimensional manipulative puzzle according to claim 1 wherein said ring member is made from two interlocking members.

6. The three-dimensional manipulative puzzle according to claim 2 wherein said but geometrical symbols comprise stars.

* * * * *